US009677857B2

(12) United States Patent
Svane et al.

(10) Patent No.: US 9,677,857 B2
(45) Date of Patent: Jun. 13, 2017

(54) IMPULSE AND MOMENTUM TRANSFER DEVISE

(71) Applicant: Ten Cate Active Protection APS, Vissenbjerg (DK)

(72) Inventors: Dorthe Wolter Svane, Aabenraa (DK); Jorgen Leif Svane, Aabenraa (DK)

(73) Assignee: Ten Cate Active Protection APS, Vissenbjerg (DK)

( * ) Notice: Subject to any disclaimer, the term of this patent is extended or adjusted under 35 U.S.C. 154(b) by 0 days.

(21) Appl. No.: 15/202,041

(22) Filed: Jul. 5, 2016

(65) Prior Publication Data

US 2016/0377386 A1 Dec. 29, 2016

Related U.S. Application Data

(63) Continuation of application No. 12/460,921, filed on Jan. 25, 2010, now Pat. No. 9,410,771.

(51) Int. Cl.

| | |
|---|---|
| ***F41H 11/00*** | (2006.01) |
| ***F41H 5/007*** | (2006.01) |
| ***F41H 7/04*** | (2006.01) |

(52) U.S. Cl.

CPC ..... *F41H 5/007* (2013.01); *F41H 7/04* (2013.01)

(58) Field of Classification Search

USPC ..... 89/36.17, 36.2, 902, 36.02, 36.08, 36.09

See application file for complete search history.

(56) References Cited

U.S. PATENT DOCUMENTS 3,580,354 A 5/1971 Hewitt
3,793,498 A * 2/1974 Matsui ..... H01H 35/142 180/274

(Continued)

FOREIGN PATENT DOCUMENTS

DE 2031658 7/1979
DE 3118377 6/1982

(Continued)

OTHER PUBLICATIONS

*U.S. Appl. No. 12/460,921, Non-Final Rejection dated Apr. 8, 2011.

(Continued)

*Primary Examiner* — J. Woodrow Eldred
(74) *Attorney, Agent, or Firm* — Kilpatrick Townsend & Stockton LLP; Dean W. Russell

(57) ABSTRACT

This invention concerns a device for the transmission of impulse and momentum, e.g. from a shock wave from an explosion or momentum from objects impacting the device, from one location to another, and is primarily used to protect vehicles, ships, aircrafts and buildings against impulse and/or momentum, for instance in regards to attacks on those with grenades, bombs, mines and the like.

Figure 1A:
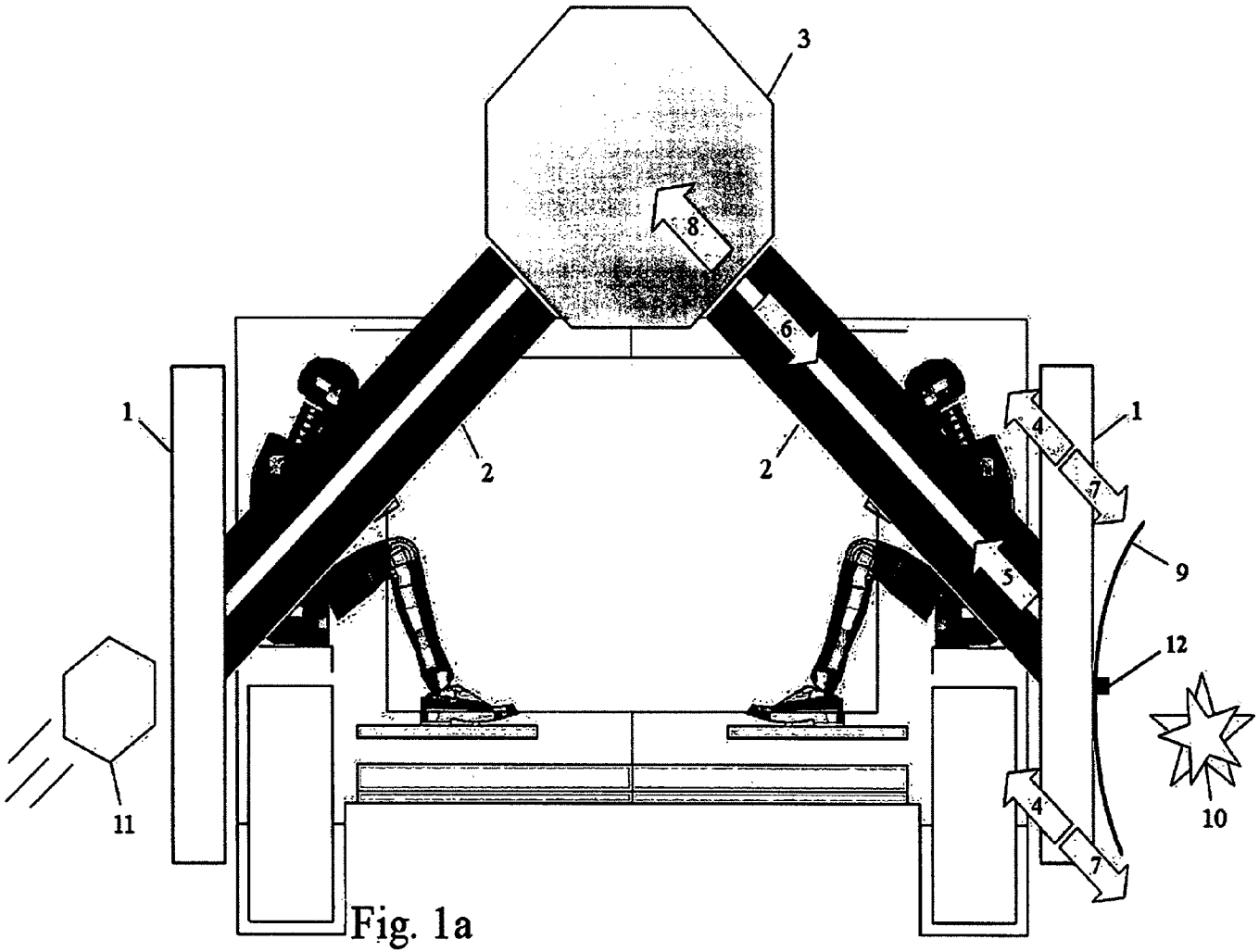

The governing physical principles are those of conservation of momentum and energy, and Newton's 3rd Law, claiming that for every action there is an equal but opposite reaction. When the receiver 1 is accelerated by the incoming shock wave 9 it collides with the transmitter 2, connected to an emitter 3, momentum is transferred to the emitter 3. If the transfer is in itself not sufficient to bring the receiver's 1 velocity to an acceptable level, additional energy and momentum is added through the transmitter 2.

3 Claims, 8 Drawing Sheets

(56) References Cited

U.S. PATENT DOCUMENTS

| | | | | |
|---|---|---|---|---|
| 3,995,656 | A | 12/1976 | Mills, Jr. | |
| 5,012,721 | A | 5/1991 | Medin et al. | |
| 5,401,055 | A | 3/1995 | Pham | |
| 5,625,160 | A | 4/1997 | Rudolf et al. | |
| 5,765,783 | A | 6/1998 | Albion | |
| 5,931,499 | A | 8/1999 | Sutherland | |
| 5,947,543 | A * | 9/1999 | Hubbard | B60N 2/4221 296/68.1 |
| 6,065,558 | A | 5/2000 | Wielenga | |
| 6,095,459 | A | 8/2000 | Codina | |
| 6,170,847 | B1 | 1/2001 | Pham | |
| 6,394,738 | B1 | 5/2002 | Springer | |
| 6,556,908 | B1 | 4/2003 | Lu et al. | |
| 6,588,799 | B1 | 7/2003 | Sanchez | |
| 6,938,924 | B2 | 9/2005 | Feldman et al. | |
| 7,421,936 | B2 * | 9/2008 | Barger | F41H 5/007 86/50 |
| 7,494,153 | B2 | 2/2009 | Wang | |
| 2004/0200347 | A1 | 10/2004 | Grosch | |
| 2005/0230176 | A1 | 10/2005 | Wang | |
| 2006/0027419 | A1 | 2/2006 | Ponomarev et al. | |
| 2006/0086243 | A1 | 4/2006 | Seo et al. | |
| 2007/0144337 | A1 | 6/2007 | Zhang et al. | |
| 2014/0007756 | A1 * | 1/2014 | Diaz | F41H 7/005 89/1.13 |

FOREIGN PATENT DOCUMENTS

| | | |
|---|---|---|
| DE | 2822106 | 8/1996 |
| DE | 19631715 | 1/2000 |
| DE | 19832662 | 2/2000 |
| DE | 19913845 | 6/2002 |
| DE | 10259918 | 6/2005 |
| DE | 202005006655 | 9/2005 |
| DE | 19909905 | 7/2009 |
| EP | 1382932 | 1/2004 |
| EP | 1467171 | 10/2004 |
| EP | 1754949 | 2/2007 |
| EP | 2003418 | 2/2008 |
| FR | 2907206 | 4/2008 |
| RU | 2003127462 | 3/2005 |
| WO | 0239048 | 5/2002 |
| WO | 2004106840 | 12/2004 |
| WO | 2005113330 | 12/2005 |
| WO | 2006034528 | 4/2006 |
| WO | 2008063205 | 5/2008 |
| WO | 2009114172 | 9/2009 |
| WO | 2009117648 | 9/2009 |
| WO | 2010067093 | 6/2010 |

OTHER PUBLICATIONS

*U.S. Appl. No. 12/460,921, Notice of Allowability dated Feb. 14, 2012.

*U.S. Appl. No. 12/460,921, Notice of Allowance and Fee(s) Due dated Jun. 8, 2016.

* cited by examiner

IMPULSE AND MOMENTUM TRANSFER DEVISE

CROSS-REFERENCE TO RELATED APPLICATIONS

This application is a continuation of U.S. application Ser. No. 12/460,921, filed on Jan. 25, 2010, which application claims priority of the Danish patent applications PA 2009 00176 and PA 2009 00389, filed by the present inventors on the 6 of Feb. 2009 and the 21 of Mar. 2009, respectively.

BACKGROUND

Prior Art

The following is a tabulation of some prior art that presently appears relevant:

Patent or Patent Application Publications

| Number | Applicant(s) or Patentee(s) | Date |
|---|---|---|
| WO0239048 (A2) | PRETORIUS GERHARDUS DIRK PETRU; VAN NIEKERK BECKER | 2002 May 16 |
| RU 2003127462 (A) | AFANAS'EV V. A.; GEVLICH A. N.; TAGIROV R. M. | 2005 Mar. 27 |
| WO 2004106840 (A1) | JOYNT VERNON P. | 2004 Dec. 9 |
| EP1382932 (A1) | MEYER HELMUT | 2004 Jan. 21 |
| DE19832662 (A1) | HELD MANFRED | 2000 Feb. 3 |
| WO2005113330 (A1) | HEYWARD GEORGE; REICHARD RONAL | 2005 Dec. 1 |
| US2004/0200347 (A1) | GROSCH HERMANN | 2004 Oct. 14 |

Protection of both military and civilian vehicles, ships, aircrafts and buildings has become increasingly topical, especially in the fight against non-state combatants. During the cold war the threat to military vehicles, ships, aircrafts, buildings and installations was clearly defined in terms of industrially manufactured weapons. In war against non-state combatants, such as terrorists and insurgents, this is no longer the case. Asymmetric opponents are rarely engaging in conventional confrontations. Instead, they are trying to hit and destroy a single vehicle, ship, aircraft or building with a massive attack often by using explosives in the form of "Improvised Explosive Devises" (IEDs). Their objective is typically to harm as many people as possible in order to spread fear, gain publicity etc.

Through the ages different weapons have been used, ranging from explosives, shape charges (SC) and explosively formed projectiles (EFP). The explosives work by punching e.g. a vehicle's side or belly plate inward, and thereby harm the occupants. SC and EFP perforate e.g. a vehicle's side or belly plate and cause injury to the occupants directly.

In recent times, there has been great focus on the protection of the objects in question. The development of armor steel, ceramic, Kevlar and a wide range of composite materials has sharply reduced the effectiveness of such attacks. For attacks with explosives, in particular, the ability to maintain the vehicle's, ship's, aircraft's or building's structural integrity is crucial for the protection of the occupants. Moreover, designers have tried to distribute the effect (energy and momentum) of the attack throughout the whole structure. The response from the asymmetric opponent is therefore to increase the mass of the explosive charge. This results in an increased acceleration in the inbound direction (local acceleration) for both vehicles, ships, aircrafts or buildings surfaces facing the explosion but also in an increased global acceleration of the entire vehicle, ship, aircraft or building structure. Occupants inside those objects can therefore be harmed as a result of being impacted by the inner side of a surface or as a result of the global acceleration, which can be up till hundreds of g's (acceleration due to gravity, 9.81 $m/s^2$). To protect the occupants against these effects, space is created to allow the surfaces to bulge inward, without impacting occupants in the object. Additionally, different materials and geometries to minimize deflection are often used as well. This may also to some extent be achieved by build-in spring-damper devices and/or crushing elements to absorb energy at a given force threshold. Regarding global acceleration, seats and floors with chock absorbing materials are often used. The object can also be designed having a shape which deflects an incoming object or pressure wave e.g. vehicles having a V-shaped belly. Another important factor against global acceleration is the weight of the object. According to Newton's $2^{nd}$ Law, acceleration is inversely proportional to the object's mass. However, having a high weight is problematic in a number of other contexts, such as cross country driving, speed and driving performance in general.

Generally, prior art has addressed the threats in three ways. Firstly, strong materials like hardened steel alloys, composites etc. have been developed in order to withstand the blast impulse from explosions as well as the penetrating capabilities of projectiles and fragments. Such materials are used as receiving bodies to shield, deflect or absorb. In cases with large quantities of energy and momentum, shielding is not enough to prevent occupant injury. In such cases, energy and momentum are mitigated in two ways in order to decrease accelerations; deflection and/or absorption. Deflection is used to prevent transfer of energy and momentum to the structure, whereas absorption is used either to absorb the energy and momentum in less critical areas of the structure or in decoupling systems like suspended seats. Deflection minimizes the forces acting on the object resulting in lower accelerations. Absorption on the other hand, minimizes the peak forces acting on an object. In principle, the impulse stays the same resulting in, that the acting forces although having a lower peak are stretched in time. Deflective and absorbing devises normally have rather large space claims which in most cases are not desirable for military platforms.

More novel designs like the invention described in WO0239048 (A2) mentioned above seems to overcome the issue of having a large space claim by turning the outer part of the receiving face into a deflective shield by means of the impulse generated by onboard explosives. Although, such a device may be able to mitigate global acceleration caused by the impulse from small to medium explosive charges, it is highly time critical as it has to work on a sub-millisecond time scale. The control unit must initiate the onboard explosives based on very few data samples, potentially leading to high false alarm rates. It is likely to make matters worse though with respect to local acceleration causing the belly plate to bulge even further. This is also the case in an overmatch scenario in which the onboard explosives is unable to deploy the deflecting shield because of a higher apposing impulse originating from the threat. Threats off-axis relative to the vehicle's longitudinal center axis may also cause additional lateral (horizontal) accelerations.

Another novel approach is given by the invention described in US2004/0200347 (A1) mentioned above. Energy and momentum are prevented from being transferred to critical parts of a vehicle e.g. the crew compartment by chopping off wheels and/or parts of the vehicle body. As appose to the previous invention this concept has its optimum performance when the threat is off-axis relative to the vehicle's longitudinal center axis. The blast impulse is still going to hit the critical parts of the vehicle though and only the energy and momentum transmitted through wheels and other parts hereto are omitted. However, these non-critical parts have masses too, but they no longer contribute in reducing the acceleration of say the crew compartment. In addition, the time frame for transmitting most of the energy and momentum through wheels and body parts is indeed very narrow, as this is done predominately in the form of shock waves. These in turn, are likely to tear off or shatter wheels and other body parts anyway. Hence, the system needs to be faster than the shock waves travelling through axels etc. Steel has a sonic velocity of more than 5000 m/s. For most vehicle designs this devise has to work on a sub-millisecond time scale too, giving rise to the same or similar problems as mentioned above.

Both of the above mentioned inventions suffer from the uncertainty of the threat position as well as being extremely time critical. Although they may reduce the amount of transferred energy and momentum, the predominant factor governing vehicle mine or blast protection is the mass of the vehicle as it is independent of threat position and keeps acceleration down due to any force, continuously. In both cases, at least the peak forces arising from the blast impulse acting on the vehicle or its critical parts are attempted reduced.

Although, deflecting and absorbing arrangements may have taken prior art to higher levels, they have definitely reached their limits when used on platforms of suitable size and mass for military and other purposes.

SUMMERY

It is the purpose of this invention to prevent or minimize the momentum absorption—and thus local and global acceleration (s) in for instance the protected part(s) of a vehicle, ship, aircraft or building.

This invention comprises a protective device for the transmission of impulse and/or momentum from shock waves caused by explosions and/or from impacting objects, predominantly to protect vehicles, ships, aircrafts or buildings, having a receiver 1 in the form of a face, surface or plate absorbing impulse and/or momentum, and further comprising:

a. A transmitter 2, wherein impulse and/or momentum is transmitted to;

b. An emitter 3 comprising an ejectable mass.

Advantages

Very high protection levels are achievable even for conventional, existing combat vehicles. Both local and global accelerations are suppressed resulting in minimum local bulge and minimum global displacement. The prior reduces the need for safety distance between attacked faces and occupants. The later facilitates higher effectiveness of suspended seats because they do not run out of stroke.

Not only occupants but also the vehicle, ship, aircraft or building itself is protected and thus enabling high in-theatre availability at reduced costs. Low sensitivity to threat position as energy and momentum can be transmitted away from the entire face under attack. Although, some embodiment's successful operation is time dependant, there is no need to operate on a sub-millisecond time scale. Possible redundancy in the activation process for most embodiments due to feasible mechanical backup initiation reduces risk of delays or malfunctions in the primary activation circuit.

Compatible with high-end prior art, including inventions like WO0239048 (A2) and US2004/0200347 mentioned above, several combined embodiments are possible in order to utilize all advantages.

DRAWINGS

Figures

FIG. 1*a*: Example of a passive embodiment of the impulse and momentum transfer device used for side protection of a vehicle.

Figure 1B:
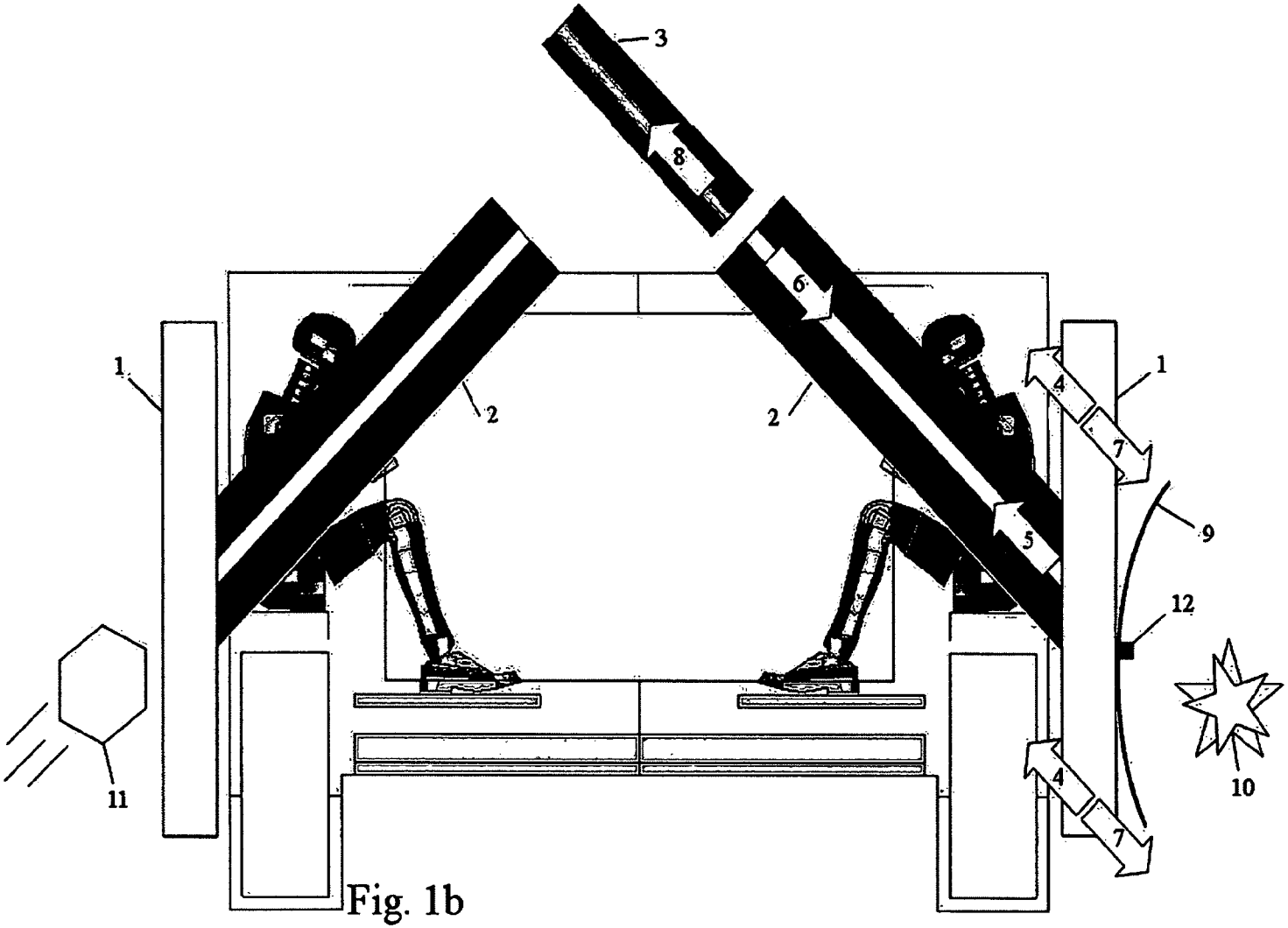

FIG. 1*b*: Example of an active embodiment of the impulse and momentum transfer device used for side protection of a vehicle.

Figure 2A:
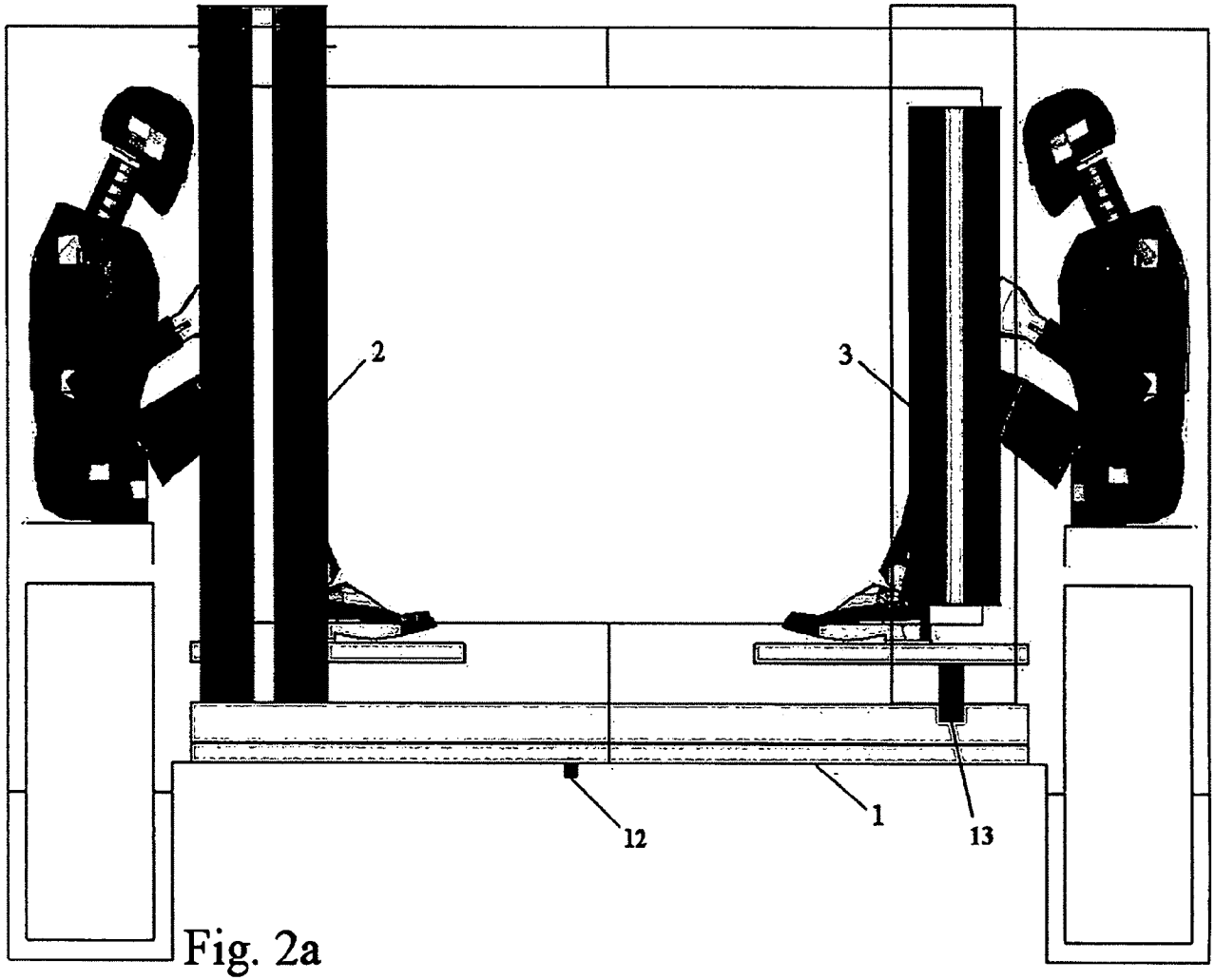

FIG. 2*a*: Example of an active embodiment of the impulse and momentum transfer device used for belly protection of a vehicle prior to activation.

Figure 2B:
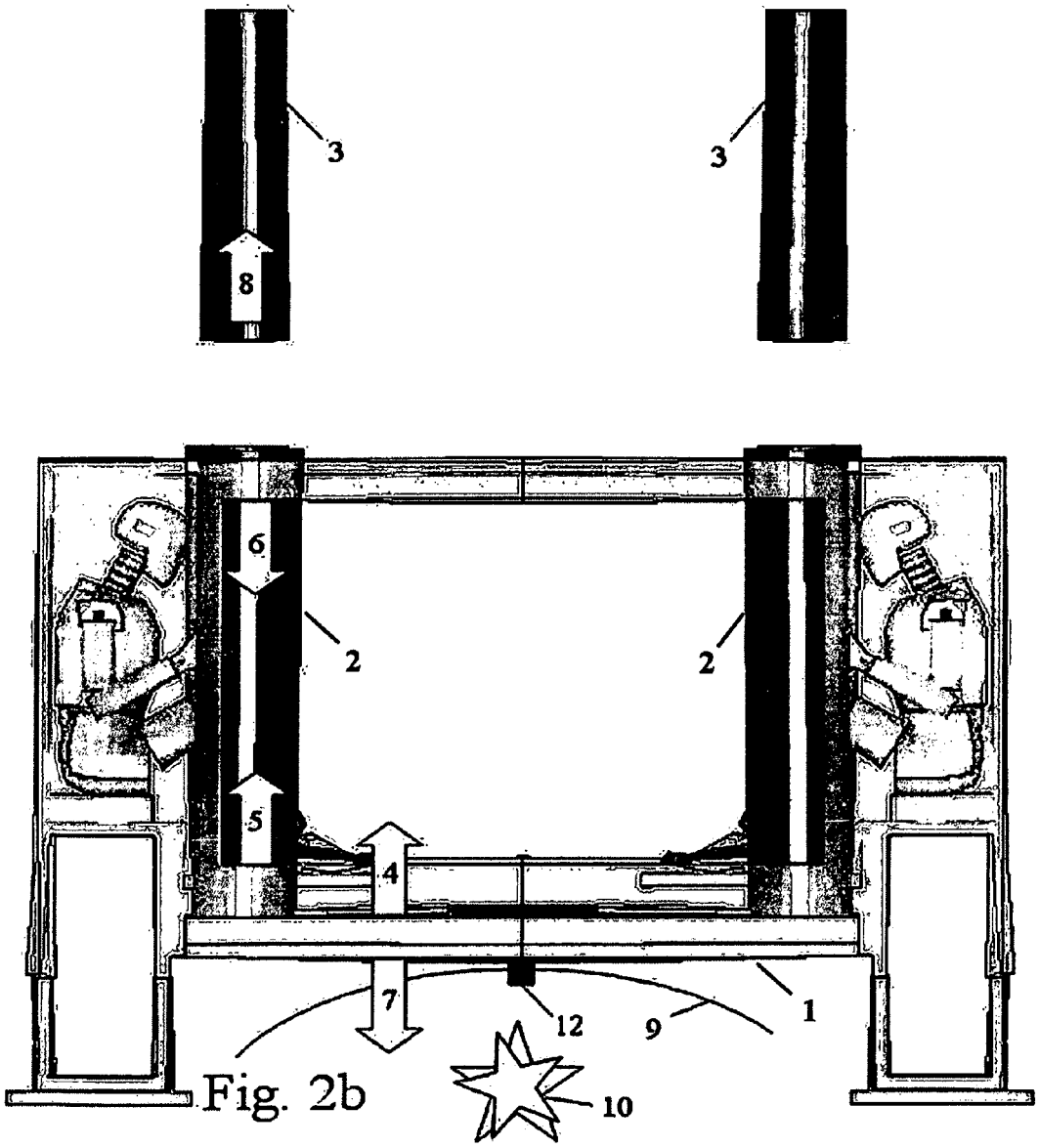

FIG. 2*b*: Example of an active embodiment of the impulse and momentum transfer device used for belly protection of a vehicle during activation.

Figure 3A:
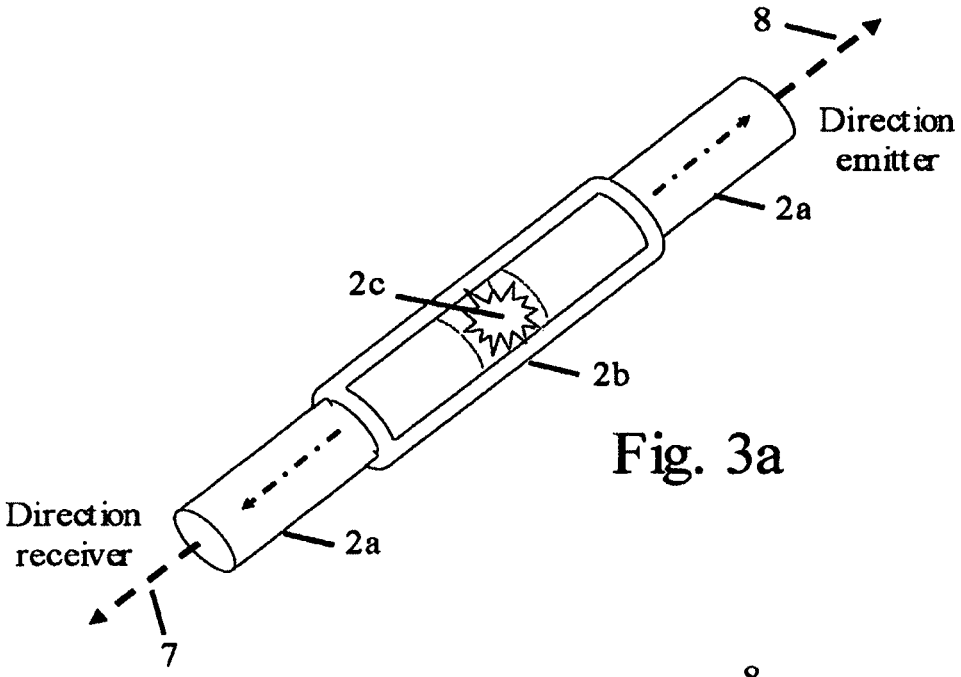

FIG. 3*a*: Example of transmitter 2 designs used in some embodiments able to add energy and momentum using an energy source based on pyrotechnics or explosives.

Figure 3B:
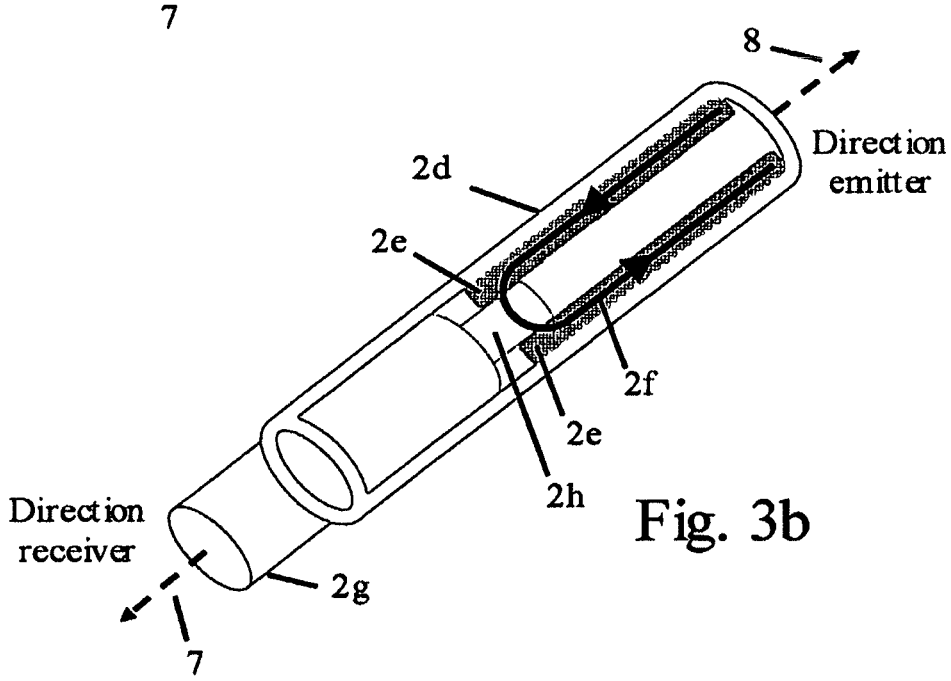

FIG. 3*b*: Example of transmitter 2 designs used in some embodiments able to add energy and momentum using an electric energy source.

Figure 4A:
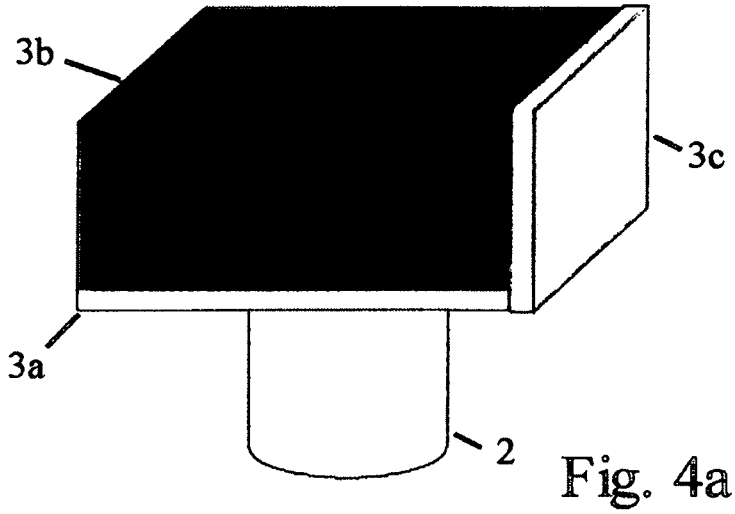

FIG. 4*a*: Example of an embodiment of the emitter 3 with liquid or powder/granules.

Figure 4B:
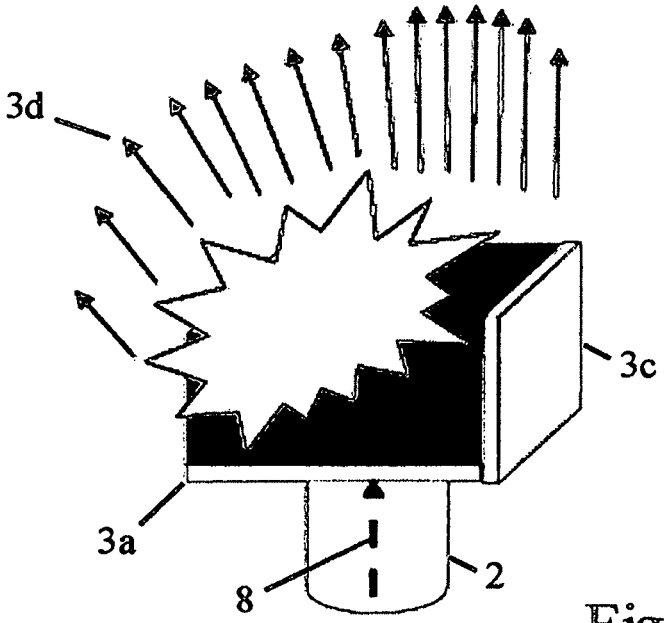

FIG. 4*b*: Example of an embodiment of the emitter 3 with liquid or powder/granules during activation.

Figure 5:
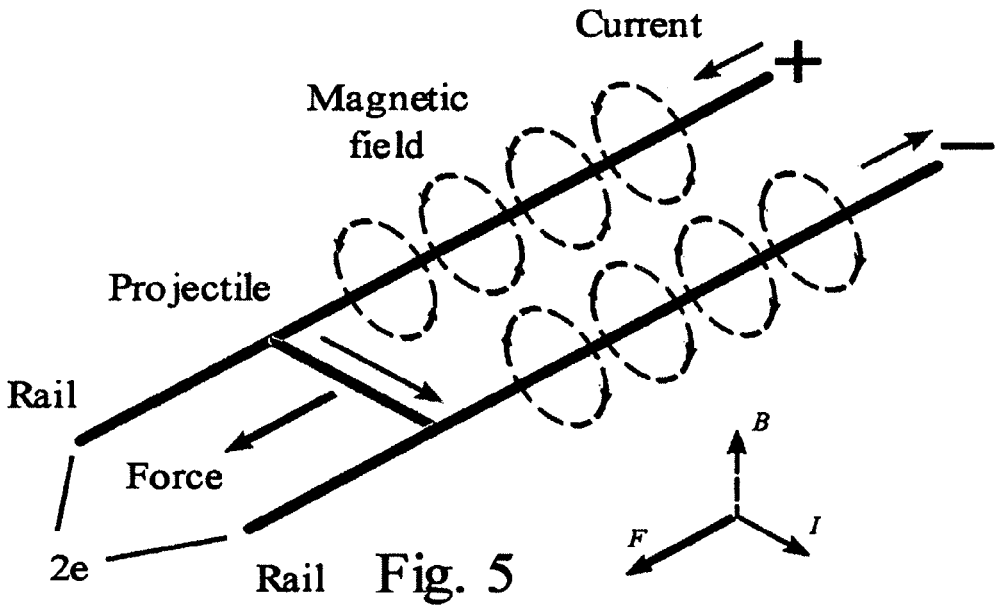

FIG. 5: Principle sketch of a railgun.

Figure 6:
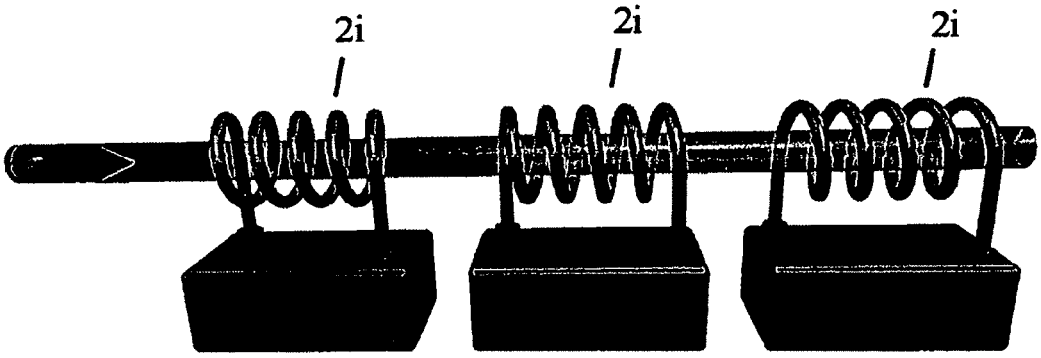

FIG. 6: Principle sketch of a coilgun.

Figure 7:
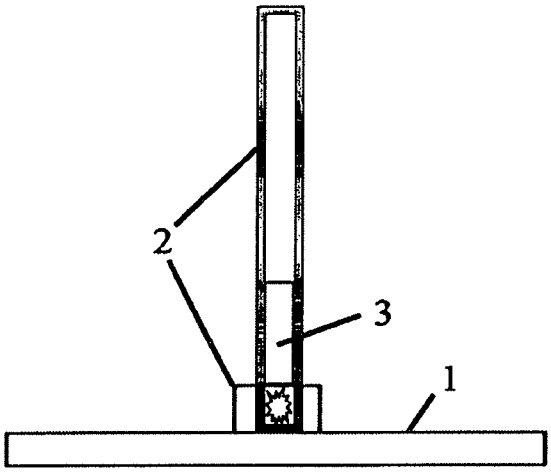

FIG. 7: Example of impulse and momentum transfer device.

Figure 8:
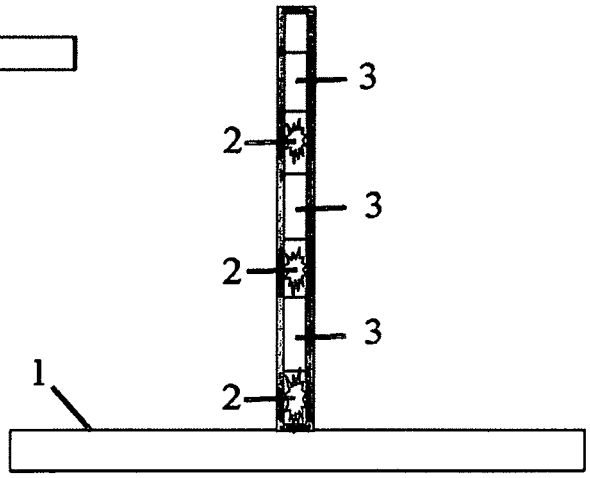

FIG. 8: Example of impulse and momentum transfer device.

Figure 9:
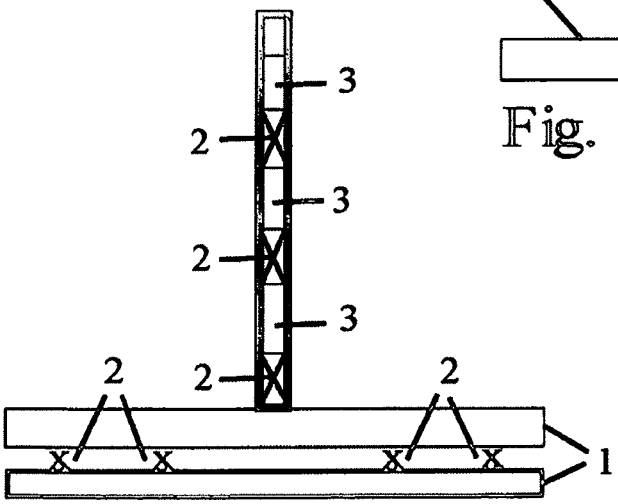

FIG. 9: Example of impulse and momentum transfer device.

DETAILED DESCRIPTION

It is the purpose of the invention to prevent or minimize the momentum absorption—and thus local and global acceleration (s)—in for instance the protected part(s) of a vehicle, ship, aircraft or building.

This is achieved by a protective device, as stated initially, which is particular by further including a transmitter 2 designed to transmit impulse and/or momentum to an emitter 3 comprising an ejectable mass.

The governing physical principles are those of conservation of momentum and energy, and Newton's 3rd Law, claiming that for every action there is an equal but opposite reaction.

When the receiver 1 is accelerated by the incoming shock wave or an object having momentum, the receiver 1 transmits its momentum through the transmitter 2 to the emitter 3. By doing so, the emitter 3 is ejected away from the vehicle, ship, aircraft or building. In the passive case, where there are no energy and momentum added in the transmitter 2, the receiver 1 will lose its momentum to both the transmitter 2 and emitter 3. In the following totally inelastic case it is assumed, that the transmitter 2 and the emitter 3 have zero initial velocity and that the transmitter 2 velocity remains zero after momentum transfer:

$$m_r v_{r1} + m_t 0 + m_e 0 = m_r v_{r2} + m_t o + m_e v_e \Longrightarrow \quad (1)$$

$$v_e = \frac{m_r(v_{r1} - v_{r2})}{m_e} \quad (2)$$

Where:

$m_r$ is the mass of the receiver 1, $v_{r1}$ is the velocity of the receiver 1 immediately before the transfer of momentum through the transmitter 2, (generated by external impulse and/or momentum), $v_{r2}$ is the velocity of the receiver 1 after momentum transfer, $m_t$ is the mass of the transmitter 2

$m_e$ is the mass of emitter 3 and $v_c$ is the velocity of the emitter 3 after momentum transfer, For the energy we have:

$$\frac{1}{2}m_r v_{r1}^2 + \frac{1}{2}m_t 0^2 + \frac{1}{2}m_e 0^2 = \frac{1}{2}m_r v_{r2}^2 + \frac{1}{2}m_t 0^2 + \frac{1}{2}m_e v_e^2 \quad (3)$$

By inserting equation (2) into equation (3) and simplifying we have:

$$v_{r2} = \pm\sqrt{\frac{m_r v_{r1}^2 - m_e v_e^2}{m_r}} \quad (4)$$

Energy and momentum can be supplied through for instance pyrotechnic and explosive materials or by using electromagnetic fields. By adding momentum H, corresponding to the energy E, these are added on the left hand side of equation (1) and (3), respectively. Hence, equation (4) is rewritten to:

$$v_{r2} = \pm\sqrt{\frac{m_r v_{r1}^2 - m_e v_e^2 - 2E}{m_r}} \quad (5)$$

By optimizing the values of the terms, the mass of the receiver 1, $m_r$, and the mass of emitter 3, $m_e$, as well as the added momentum, H, and the energy input, E, is it possible to reduce the velocity of the receiver 1, $v_{r2}$, after impulse and momentum transfer, down to approximate zero, or below a desired value.

In general, the receiver 1 is stopped, usually before it collides with the protected parts of the vehicle, ship, aircraft or building. Hereby local and/or global acceleration(s) of the vehicle, ship, aircraft or building are prevented or minimized.

By measuring the velocity of the receiver 1 prior to impact, $v_{r1}$, a fast control system is able to control the amount the added amount of momentum and energy in order to adjust the response within a given rang. This is particularly the case for an electric system.

EMBODIMENTS

In accordance with one embodiment, a protective device comprises a transmitter 2 and an emitter 3. The transmitter 2 is transferring energy and momentum from a receiver 1, i.e. a face or surface under attack to an emitter 3 that is ejected in a somewhat opposite direction relative to the attack.

The receiver 1 may be V-shaped, where the "bottom" of the V is facing the incoming impulse or objects having momentum. It provides a partial deflection of these, so that the momentum absorbed in the receiver 1 is reduced. The receiver 1 may in some cases be integrated directly into the surface (side, bottom, roof, ceiling or wall), it is to protect.

The receiver 1 can be made in one or more materials with high acoustic velocity. Such materials have in experiments shown better performance in terms of dissipation of shock waves. A typical material might be high-strength steel. The receiver 1 can also be made in one or more materials with high ballistic resistance (ballistic limit). This is crucial to avoid that objects having momentum perforate the receiver 1 and thereby impact the parts of the vehicle, ship, aircraft or buildings that are to be protected. Material possibilities include armor steel, ceramics and Kevlar.

In other cases, the receiver 1 can be entirely or partially made of materials with low acoustic velocity and great elasticity to reduce the dynamic pressure, also referred to as the reflected pressure. This reduces the shock impact and the maximum reflected pressure significantly. The total impulse from the shock wave (9) is in principle not reduced though, as the duration of the impulse is extended. By doing so, additional time to initiation and operation of energy and momentum adding elements is gained. A suitable material could be certain high density polymers (HDP).

The transmitter 2 can be made as a passive member, such as continuous rods or fluid-filled pipes that can carry the momentum from the receiver 1 to the emitter 3. In particular, in the passive case—but also in the reactive or active case—it is crucial that material properties (e.g. mass and stiffness) and design are attuned to both the receiver 1 and emitter 3, thereby achieving maximum momentum transfer within a given range.

The transmitter 2 used in some embodiments is able to add energy and momentum when made as continuous elongated cylinders, containing an energetic substance and an internal piston. The energetic substance of pyrotechnic or explosive nature, is ignited or initiated and adds momentum to both the emitter 3 and hence the receiver 1—in opposite directions—according to the same principle as in a gun, where the emitter 3 is the shot being lunched and the receiver 1 corresponds to the recoiling gun.

In some embodiments the transmitter 2 is able to add energy and momentum, e.g. as rods with coils 21 or rails **2*e* and armatures 2*h* capable of performing mechanical work when an electrical current is passed through. The principles are known as "coil" and "railgun". Especially, the railgun principle is desirable, since the reaction to the receiver's 1 action is communicated through the momentum carrying field, straight to the rear end of the rails 2*e*, where it is acting directly on the emitter 3. In both methods, the transmitter 2** serves as a gun in the same manner as described above.

The transmitter 2 used in some embodiments is able to add energy and momentum reactively as the receiver's 1 motion relative to the transmitter 2 and the emitter 3 by example, say by percussion caps or by an electric motion switch, switching current when the receiver 1 distance traveled or achieved speed exceeds a predetermined size. This obviates the need for sensors that can be inhibited by mud, water, direct jamming and the like.

The transmitter 2 used in some embodiments is able to add energy and momentum actively on a signal from a sensor. Sensors, such as radar, pressure transducers or thermo-couples can be used to pre-activate the transmitter 2, so that the receiver 1 gets momentum in a direction away from the vehicle, ship, aircraft or building prior to blast or objects having momentum impact the receiver 1. This allows the required power (energy per. time unit) to be reduced and the ejection of the emitter 3 less violent reducing third party risk.

The emitter 3 is the part that is to carry the momentum away from the protected vehicle, ship, aircraft or building. Depending on the situation and the platform on which it is used, it can either be an advantage to obtain very high speed or a lower speed. Regardless of the direction or area in which it is ejected, it is important that it is brought to a halt as fast as possible, to avoid or minimize the risk to third parties. The proposed emitter 3 in this invention will therefore often be in the form of containers in a disintegrating material containing liquid or powder/granules. The latter can also be tied in resin to increase the energy and momentum absorption when it disintegrates during the acceleration. Once the emitter 3 is accelerated due to momentum obtained from the transmitter 2, one may seek to add a mechanical shock, which disintegrates the containers and only liquid or powder/granules are ejected in the desired direction or area. Liquid and powder/granules will rapidly lose momentum due to air resistance and/or gravity. If deemed necessary, the used container may be fitted with a parachute system. In special cases, the emitter 3 simply is the opposing receiver 1.

The emitter 3 can principally be placed arbitrarily, from where ejecting is considered appropriate. In special cases the emitter 3 is a gas, which is ejected as supersonic flow.

The transmitter 2 used in some embodiments is entirely or partially containing or surrounded by the emitter 3, e.g. by lunching the emitter 3 through the transmitter 2—like a shot lunched from a gun—or alternatively as supersonic flow—similar to a rocket. In some embodiments the transmitter 2 is integrated with the receiver 1 so that at least parts of the energy and momentum added take place in the receiver 1. Additionally, some embodiments may comprise a multistage receiver 1—transmitter 2—emitter 3 system to perform impulse and momentum transfer. This will make it possible to reduce the local effects of initiation and the operation of energy and momentum adding elements as these are distributed.

The transmitter 2 used in some embodiments is closely integrated with the emitter 3 so that at least parts of the energy and momentum added take place in the emitter 3.

The transmitter 2 used in some embodiments is closely integrated with the receiver 1 so that at least parts of the energy and momentum added take place in the receiver 1.

The transmitter 2 used in some embodiments is made as a multi-loop system, which makes it possible to place energy sources in the periphery of the system and have current loops in both directions—both to the receiver 1 and emitter 3. This will make it possible to reduce the local effects of switching high currents and the operation of energy and momentum adding elements as these are distributed.

DETAILED DESCRIPTION OF THE DRAWINGS

In the following the invention is explained based on examples of how it could be implemented on a ground vehicle with regards to the schematic drawings.

FIG. 1*a*, FIG. 1*b*, FIG. 2*a* and FIG. 2*b*: The figures are based on that the impulse and momentum transfer device is used as blast and/or fragmentation protection of a vehicle's side and belly. On the figures it is shown how the explosion 10 generates a shock wave 9 impacting the receiver 1. The left hand side of FIG. 1*a* and FIG. 1*b* shows a collision with an object 11 having momentum, and on the right hand side of FIG. 1*a* and FIG. 1*b* is illustrated a shock wave 9 from an explosion 10. The operation of the invention found in FIG. 1*a* and FIG. 1*b* is only shown for the impulse from the shock wave 9. In FIG. 2*b* the shock wave 9 from an under-belly explosion 10 is illustrated. The operation of the invention found in FIG. 2*b* is only illustrated for the under belly shock wave 9. The receiver 1, gaining momentum 4, from the shock wave 9, which is transferred as forces 5 in the transmitter 2. Reactions to these forces 6 are generated as a result of acceleration of the emitter 3, thereby gaining momentum 8, and possibly also by additional energy and momentum added in the transmitter 2—see FIGS. 3*a* and 3*b*. Hence, the reaction forces 6 add momentum 7 to the receiver 1. If the system is properly tuned momentum 7 and momentum 4 cancel out.

FIG. 3*a*: Example of transmitter 2 design used in some embodiments capable of adding energy and momentum. The transmitter 2 comprises a cylinder 2*b* and two pistons 2*a*, which is pushed away from each other, when the energy source 2*c* between them is released. Energy 2*c* and momentum generated in this example show the combustion of a pyrotechnic material or detonation of an explosive substance. Momentum 7, 8 is hereby added to the receiver 1 and the emitter 3.

FIG. 3*b*: Example of transmitter 2 design used in some embodiments capable of adding energy and momentum. The transmitter 2 comprises a guiding body 2*d* and two rails 2*e*, where the electric current 2*f* runs and a guiding piston 2*g* and an armature 2*h*. The guiding piston 2*g* and the armature 2*h* are electrically isolated from each other. When the current is switched, for instance by the armature 2*h* is pushed in between the rails 2*e*, the Lorentz force acts on the current 2*f* through the armature 2*h*, which in turn act on the later, and further through the guiding piston 2*g*, and down towards the receiver 1. The reaction to this force is communicated through the field down to the rear end of the rails 2*e*.

FIG. 4*a* and FIG. 4*b*: Example an embodiment of the emitter 3 with liquid or powder/granules. The emitter 3 in FIG. 4*a* and FIG. 4*b* is designed for vertical ejection, say, from the roof of a vehicle. Momentum 8 is transmitted through the transmitter 2 and continues through an acceleration plate 3*a* up into the ejectable mass of the emitter 3, stored in containers 3*b*. The screen 3*c* in the example shown, is mounted in order to avoid debris in an unwanted direction. The expected flow field 3*d*, after the disintegration of the containers 3*b* is shown in the FIG. 4*a*. It should be noted that both the content as well as the strength of the containers 3*b* may vary, and therefore it could be fluid in some, while powder/granules could be in others (within the same emitter 3). In simple embodiments, these can be e.g. water cans and sandbags.

FIG. 5: This figure is only included to illustrate the theoretical principle of the Lorentz force in a railgun, and therefore described no further.

FIG. 6: Principle sketch of coilgun. Current flows through the individual coils according to the position of the shot to maintain continuous acceleration.

FIG. 7: Example of an embodiment of the impulse and momentum transfer device in which the transmitter 2 is integrated with the emitter 3. The emitter 3 is ejected through the transmitter 2.

FIG. 8: Example of a multistage embodiment of the impulse and momentum transfer device.

FIG. 9: Example of an embodiment of the impulse and momentum transfer device, in which the receiver 1 contains an energy and momentum source and is integrated with transmitters 2, in a multistage configuration with a number of emitters 3. The transmitters 2 may have decreasing power to distribute the effects of energy and momentum discharges. The device can also be configured as a multistage cascade system. Similarly, the device can be designed with energy and momentum sources in the emitter 3.

The invention claimed is:

1. A method of reducing momentum absorption by an object, comprising:

a. providing a receiver configured to move a distance D following contact with an incoming shock wave;

b. providing a transmitter comprising an electric motion switch operative when distance D exceeds a predetermined value, the transmitter receiving momentum from the moving receiver; and c. configuring an emitter for ejection through the transmitter, the emitter comprising gas ejected as supersonic flow.

2. A method of reducing momentum absorption by an object, comprising:

a. providing a receiver configured to by accelerated by an incoming shock wave;

b. providing a transmitter comprising an internal piston, the transmitter receiving momentum from the accelerated receiver; and c. configuring an emitter for ejection through the transmitter, the emitter comprising gas ejected as supersonic flow.

3. A method of reducing momentum absorption by an object, comprising:

a. providing a receiver configured to by accelerated by an incoming shock wave;

b. providing a transmitter comprising (i) an armature and (ii) a coil or rail, the transmitter receiving momentum from the accelerated receiver; and c. configuring an emitter for ejection through the transmitter, the emitter comprising gas ejected as supersonic flow.

* * * * *